US008347979B2

(12) United States Patent
Young et al.

(10) Patent No.: US 8,347,979 B2
(45) Date of Patent: Jan. 8, 2013

(54) MOTOR ASSEMBLY FOR PNEUMATIC TOOL

(75) Inventors: Randi Jane Young, Randolph, NJ (US); Nathanael S. Murphy, Hellertown, PA (US)

(73) Assignee: Ingersoll-Rand Company, Montvale, NJ (US)

( * ) Notice: Subject to any disclaimer, the term of this patent is extended or adjusted under 35 U.S.C. 154(b) by 162 days.

(21) Appl. No.: 12/914,076

(22) Filed: Oct. 28, 2010

(65) Prior Publication Data

US 2011/0036606 A1 Feb. 17, 2011

Related U.S. Application Data

(63) Continuation of application No. 12/115,172, filed on May 5, 2008, now Pat. No. 7,886,840.

(51) Int. Cl.
*B23B 45/04* (2006.01)

(52) U.S. Cl. ..... 173/168; 173/169; 173/218

(58) Field of Classification Search ..... 173/213, 173/218, 164, 168, 169, 170, 171
See application file for complete search history.

(56) References Cited

U.S. PATENT DOCUMENTS 2,267,781 A 12/1941 Albertson
3,223,182 A * 12/1965 Mikiya ..... 173/114
3,465,646 A 9/1969 Kiester et al.
3,949,944 A 4/1976 Bent
3,951,217 A 4/1976 Wallace et al.
4,173,828 A 11/1979 Lustig et al.
4,222,443 A * 9/1980 Chromy ..... 173/201
4,235,850 A 11/1980 Otto, Jr.
4,355,564 A * 10/1982 Gidlund ..... 91/217
4,379,492 A * 4/1983 Hiraoka ..... 173/181
4,403,679 A 9/1983 Snider
4,434,858 A 3/1984 Whitehouse
4,488,604 A 12/1984 Whitehouse
4,625,999 A 12/1986 Valentine et al.
4,708,210 A * 11/1987 Rahm ..... 173/169
4,735,020 A 4/1988 Schulz et al.
4,740,144 A * 4/1988 Biek ..... 418/266
4,776,561 A 10/1988 Braunlich et al.
4,779,382 A 10/1988 Rudolf et al.

(Continued)

OTHER PUBLICATIONS

Stanley Air Tools Valve, 3 Pages, Published Prior to May 5, 2008.

*Primary Examiner* — Paul R Durand
(74) *Attorney, Agent, or Firm* — Michael Best & Friedrich LLP

(57) ABSTRACT

A pneumatic impact wrench includes a handle assembly graspable by a user, a work attachment connected to the handle assembly, an inlet permitting air flow to drive the impact wrench, an outlet permitting air flow out of the impact wrench, a motor assembly positioned between the inlet and the outlet includes a rotor driven by the air flow between the inlet and the outlet. The motor assembly defines a longitudinal motor axis about which the rotor rotates. An output drive is connected to the motor assembly to selectively rotate in response to rotation of the rotor, the output drive defines a longitudinal output axis about which the output drive rotates, the longitudinal output axis is substantially perpendicular to the longitudinal motor axis, and an impact mechanism is positioned between the motor assembly and the output drive to selectively drive the output drive in response to rotation of the rotor.

14 Claims, 14 Drawing Sheets

U.S. PATENT DOCUMENTS 5,022,469 A 6/1991 Westerberg
D323,961 S 2/1992 Fushiya et al.
D335,808 S 5/1993 Bruno et al.
5,210,918 A * 5/1993 Wozniak et al. ..... 29/254
5,293,747 A 3/1994 Geiger
5,346,021 A 9/1994 Braunlich
5,346,024 A 9/1994 Geiger et al.
D352,645 S 11/1994 Ichikawa
5,443,196 A * 8/1995 Burlington ..... 227/131
5,505,676 A 4/1996 Bookshar
D372,850 S 8/1996 Dubuque et al.
5,626,198 A 5/1997 Peterson
D380,949 S 7/1997 Sung
5,813,477 A * 9/1998 Clay et al. ..... 173/1
D414,093 S 9/1999 Zurwelle
6,039,231 A 3/2000 White
6,109,366 A 8/2000 Jansson et al.
6,179,063 B1 * 1/2001 Borries et al. ..... 173/93.5
6,250,399 B1 6/2001 Giardino
D444,363 S 7/2001 Hayakawa et al.
D447,029 S 8/2001 Sun et al.
6,460,629 B2 10/2002 Bookshar et al.
D476,870 S 7/2003 Hayakawa et al.
6,691,798 B1 * 2/2004 Lindsay ..... 173/115
6,789,447 B1 9/2004 Zinck
6,796,385 B1 9/2004 Cobzaru et al.
D497,785 S 11/2004 Izumisawa
D502,071 S 2/2005 Snider
6,880,645 B2 * 4/2005 Izumisawa ..... 173/93.5
6,929,074 B1 8/2005 Lai
6,935,437 B2 8/2005 Izumisawa
D510,513 S 10/2005 Aglassinger
D511,284 S 11/2005 Henssler et al.
7,036,795 B2 5/2006 Izumisawa
7,040,414 B1 5/2006 Kuo
D525,502 S 7/2006 Chen
D529,353 S 10/2006 Wong et al.
D530,171 S 10/2006 Baker
7,140,179 B2 11/2006 Bass et al.
D569,206 S 5/2008 Takahagi et al.
7,461,704 B2 12/2008 Chen
2002/0035890 A1 3/2002 Kusachi et al.
2004/0014411 A1 1/2004 Jonas
2005/0279519 A1 12/2005 Clark
2007/0181322 A1 8/2007 Hansson et al.

* cited by examiner

MOTOR ASSEMBLY FOR PNEUMATIC TOOL

CROSS-REFERENCE TO RELATED APPLICATIONS

The present application is a continuation of U.S. application Ser. No. 12/115,172, filed May 5, 2008, the entire contents of which are herein incorporated by reference.

FIELD OF THE INVENTION

The present invention relates to motor arrangements for pneumatic tools.

SUMMARY

In one embodiment, the invention provides a motor arrangement for a pneumatic tool including a work attachment. The motor arrangement includes a single-piece motor cylinder defining a motor chamber, an inlet passage having an inlet longitudinal axis and adapted to receive a flow of motive fluid, forward and reverse passages communicating with the motor chamber, a throttle port, and at least one exhaust port communicating with the motor chamber for exhaust of motive fluid from the motor chamber. The motor arrangement also includes a motor rotor supported for rotation within the motor chamber and having an output shaft adapted for connection to the work attachment to drive operation of the work attachment. The rotor is operable to rotate in a forward direction in response to motive fluid flowing into the motor chamber from the forward passage and in a reverse direction in response to motive fluid flowing into the motor chamber from the reverse passage. The motor arrangement also includes a valve actuable to selectively place one of the forward and reverse passages in communication with the inlet passage for the provision of motive fluid from the inlet passage to the selected one of the forward and reverse passages. A throttle mechanism including a throttle actuator extends through the throttle port and is actuable to control the flow of motive fluid through the inlet passage.

In another embodiment, the invention provides a motor assembly for use in a pneumatic tool. The motor assembly includes an inlet conduit having an inlet longitudinal axis, a proximal end, and a distal end opposite the proximal end. An inlet passage communicates through the distal end and extends along the inlet longitudinal axis. The inlet conduit also includes a forward port in the exterior surface and communicating with the inlet passage, and a reverse port in the exterior surface and communicating with the inlet passage. A motor chamber wall is integrally formed with the proximal end of the inlet conduit, and defines an internal motor chamber, a first planar surface extending radially from the proximal end of the inlet conduit, and forward and reverse supply passages communicating between the first planar surface and the motor chamber. A motor rotor is supported within the motor chamber for rotation about a motor axis that is parallel to the inlet longitudinal axis. The motor rotor is adapted to rotate in a forward direction in response to motive fluid flowing into the motor chamber from the forward supply passage, and to rotate in a reverse direction in response to motive fluid flowing into the motor chamber from the reverse supply passage. The motor arrangement also includes a rotary valve including a valve passage. The rotary valve is supported by and rotatable about the proximal end of the inlet conduit between forward and reverse positions. The rotary valve places the valve passage in communication between the forward port and forward supply passage when in the forward position, and places the valve passage in communication between the reverse port and reverse supply passage when in the reverse position. The inlet passage is adapted to receive motive fluid from a source of motive fluid. The rotary valve is adapted to conduct motive fluid from the forward port to the forward supply passage to drive forward rotation of the rotor when the rotary valve is in the forward position, and is adapted to conduct motive fluid from the reverse port to the reverse supply passage to drive reverse rotation of the rotor when the rotary valve is in the reverse position.

In another embodiment, the invention provides a pneumatic tool including an inlet bushing adapted for communication with a source of motive fluid and a motor cylinder. The motor cylinder includes a motor chamber, a valve interface surface, an outer housing mounting surface, a throttle port, an inlet passage, an inlet bushing interface to which the inlet bushing is mounted such that motive fluid may be supplied to the inlet passage through the inlet bushing, and forward and reverse supply passages communicating between the valve interface surface and the motor chamber. A motor rotor is supported within the motor chamber for rotation about a motor axis in a forward direction in response to motive fluid flowing into the motor chamber through the forward supply passage, and in a reverse direction in response to motive fluid flowing into the motor chamber through the reverse supply passage. A valve is adjacent the valve interface and is actuable between a forward position in which the valve communicates between the inlet passage and the forward supply passage for driving the motor rotor in the forward direction, and a reverse position in which the valve communicates between the inlet passage and the reverse supply passage for driving the motor rotor in the reverse direction. A throttle mechanism extends through the throttle port and is actuable to control the flow of motive fluid into the inlet passage from the inlet bushing. An outer housing is mounted to the outer housing mounting surface of the motor cylinder and an exhaust passage is defined between the outer housing and the motor cylinder to conduct motive fluid exhausted from the motor chamber out of the tool. A majority of the exhaust passage extends parallel to the motor axis.

In another embodiment, the invention provides a pneumatic tool including a motor cylinder having an outer surface, a motor chamber, and a flange portion with at least one cylinder mounting hole. A motor rotor is supported in the motor chamber for rotation. A motive fluid inlet supplies motive fluid to the motor chamber to drive rotation of the motor rotor. The pneumatic tool also includes a work attachment having at least one attachment mounting hole, the work attachment being interconnected to the motor rotor and operable to perform work in response to rotation of the motor rotor. At least one fastener extends through the at least one cylinder mounting hole and the at least one attachment mounting hole to mount the work attachment to the flange portion of the motor cylinder. An outer housing surrounds the motor cylinder and has an inner surface sized and shaped for a snug fit around the flange portion of the motor cylinder, such that the at least one fastener is hidden from view by the work attachment and outer housing when the tool is assembled.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
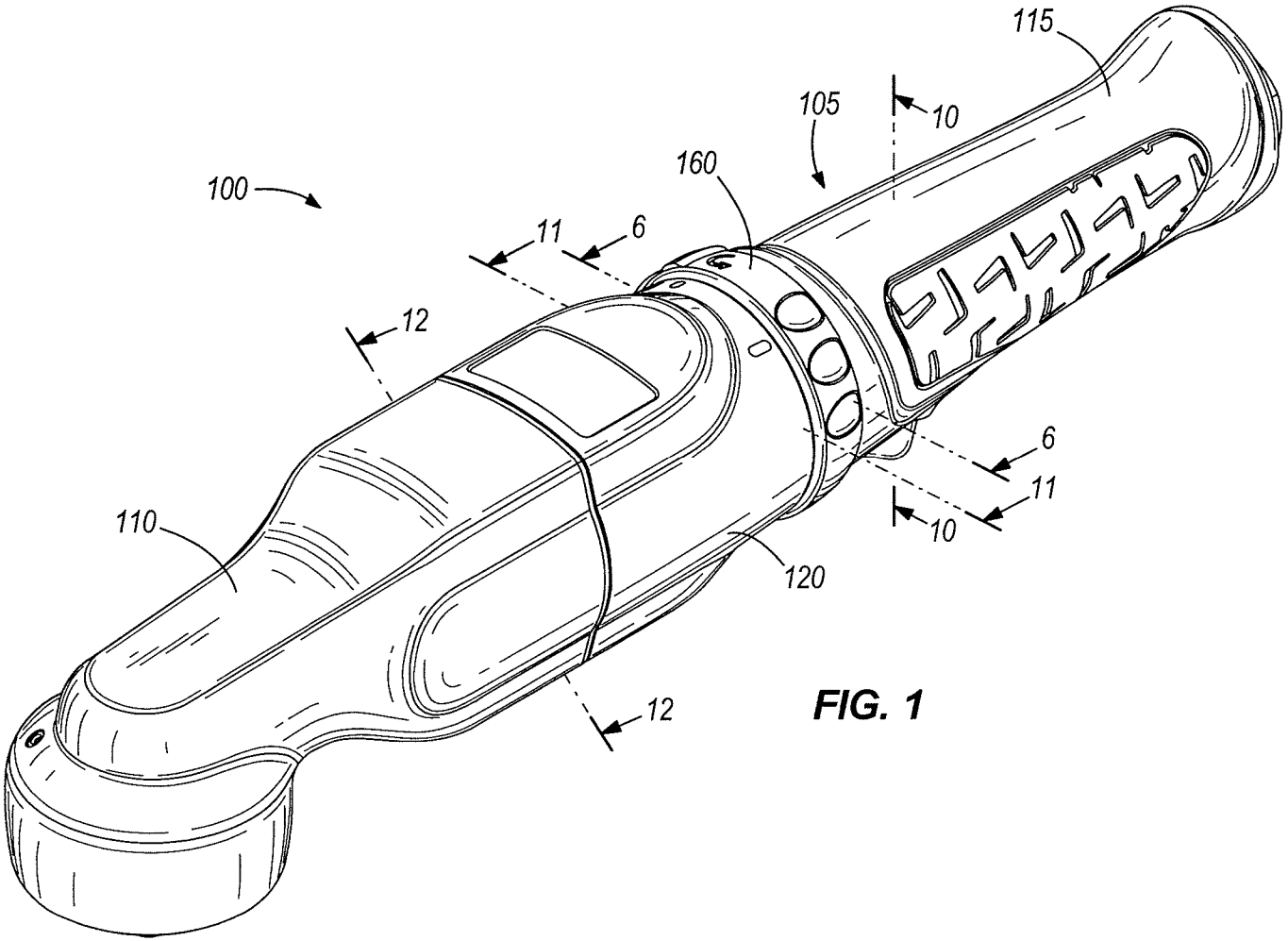
FIG. 1 is a perspective view of a pneumatic tool embodying the invention.

FIG. 1 illustrates a pneumatic tool 100 that includes a handle or motor assembly 105 and a work attachment 110. The illustrated work attachment 110 is an angle head with a square drive 113 (see FIGS. 6 and 11) to which a socket or other fastener-driving output element may be connected, but may in other constructions be substantially any tool adapted to be driven by a rotating output shaft of the motor assembly, including but not limited to an impact wrench, gear reducer, and the like.

Figure 2:
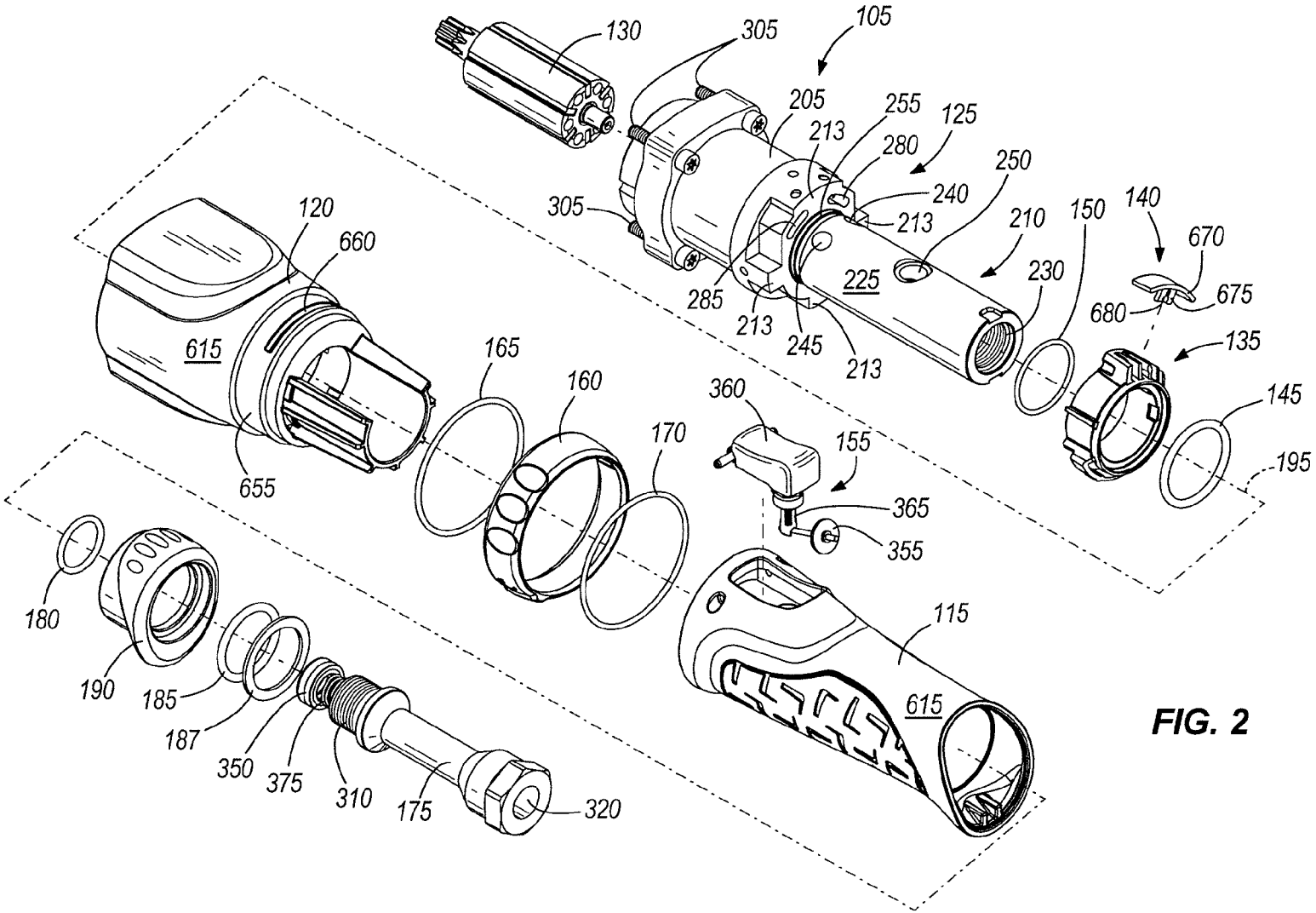
FIG. 2 is an exploded view of the handle assembly of the tool.

With reference to FIG. 2, the handle assembly 105 includes a rear housing 115, a front housing 120, a motor cylinder 125, a motor rotor 130, a rotary valve 135, a valve actuator 140, first and second valve seals 145, 150, a throttle mechanism 155, a ring 160, first and second ring seals 165, 170, an inlet bushing 175, first and second inlet seals 180, 185, an inlet washer 187 and an exhaust cap 190, along with other parts, subparts, and aspects that will be identified later. The front and rear housings 120, 115 cooperate to define an outer housing having an internal cavity in which the majority of the other elements of the handle or motor assembly 105 are housed. The handle assembly 105 includes a handle or motor longitudinal axis 195 (also called the "main axis" in this description, see also FIG. 7), and the motor cylinder 125, motor rotor 130, rotary valve 135, inlet bushing 175, and exhaust cap 190 are arranged along the handle longitudinal axis within the internal cavity of the outer housing 120, 115.

Figure 3:
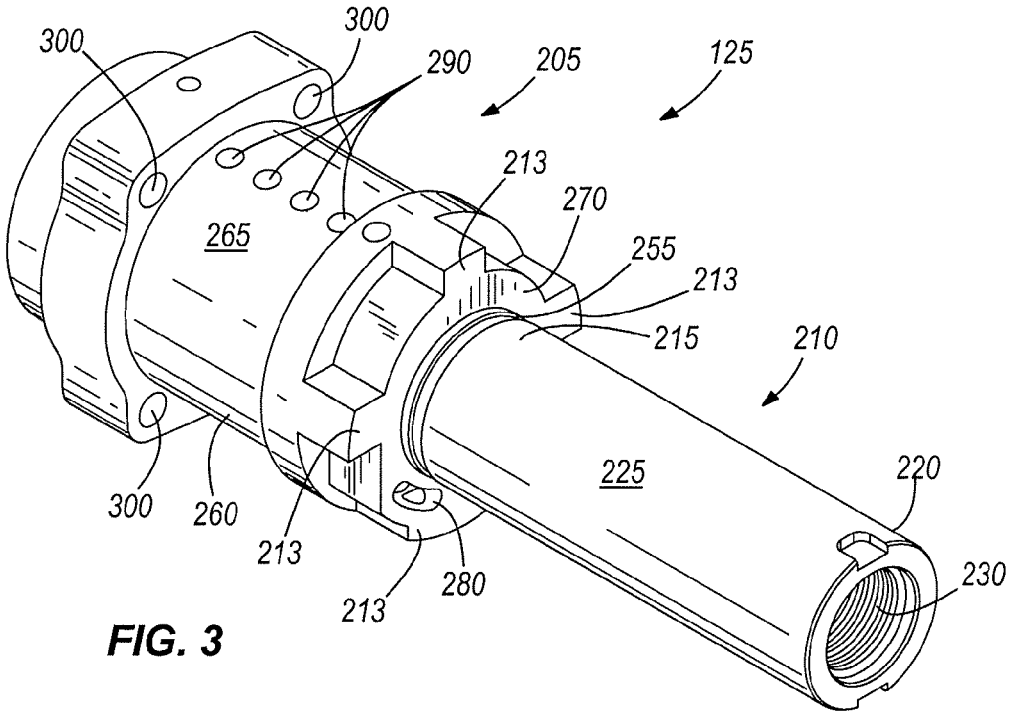
FIG. 3 is an enlarged perspective view of a motor cylinder of the handle assembly.

FIGS. 2 and 3 illustrate the motor cylinder 125, which includes a motor chamber portion 205 and an inlet conduit portion 210 integrally formed as a single piece. In the illustrated embodiment, the motor chamber portion 205 and inlet conduit portion 210 are generally cylindrical in shape. Four housing support projections 213 are integrally formed in the motor chamber portion 205 at the junction with the inlet conduit portion 210.

The motor chamber portion 205 includes a motor chamber longitudinal axis that is collinear with the main axis 195, and the inlet conduit portion 210 includes an inlet longitudinal axis or inlet axis that is also collinear with the main axis 195. The motor chamber portion 205 has a larger diameter than the inlet conduit portion 210. In other embodiments, the motor chamber portion 205 and inlet conduit portion 210 may be shaped other than illustrated.

The inlet conduit portion 210 includes a proximal end 215 integrally formed with the motor chamber portion 205 at a junction, an opposite distal end 220, and an exterior surface 225 extending between the proximal and distal ends 215, 220. An inlet passage 230 communicates with the distal end 220 (where it includes internal threads, as illustrated), extends substantially the entire length of the inlet conduit portion 210, and terminates at the proximal end 215. As used herein, a passage or port is said to "communicate" with or through a structure (e.g., the distal end 215 in the case of the inlet passage 230 or the exterior surface 225 or other surface in the case of other passages and ports described below) when it defines an aperture in the structure, and is said to communicate with another passage or port when it permits fluid flow into the other passage or port. The inlet passage 230 extends along and has a longitudinal axis collinear with the main axis 195. Communicating with the inlet passage 230 through the exterior surface 225 are a forward port 240, a reverse port 245, and a throttle port 250. A seal seat 255 is formed in and extends around the entire outer diameter of the exterior surface 225 of the inlet conduit portion 210 near the proximal end 215.

The motor chamber portion 205 of the motor cylinder 125 includes a motor chamber wall 260 that has an exterior surface 265 and that defines a first substantially planar surface 270 extending radially away from the proximal end 215 of the inlet conduit portion 210 at the junction. The first planar surface 270 surrounds the proximal end 215 and is consequently generally ring-shaped. The motor chamber wall 260 also defines a motor chamber 275 (FIGS. 7 and 8) in which the motor rotor 130 is supported for rotation about a rotor axis that is collinear with the main axis 195. Formed in the motor chamber wall 260 are a forward supply passage 280, a reverse supply passage 285, and a plurality of exhaust ports 290. The forward and reverse supply passages 280, 285 communicate between the first planar surface 270 and the motor chamber 275, and the exhaust ports 290 communicate between the motor chamber 275 and the exterior surface 265 of the motor chamber portion 205. The end of the motor chamber portion 205 opposite the first planar surface 270 has a plurality of cylinder mounting holes 300 that receive a plurality of fasteners 305 for securing the work attachment 110 to the motor cylinder 125. In this regard, the end of the motor chamber portion 205 acts as a mounting flange.

Figure 7:
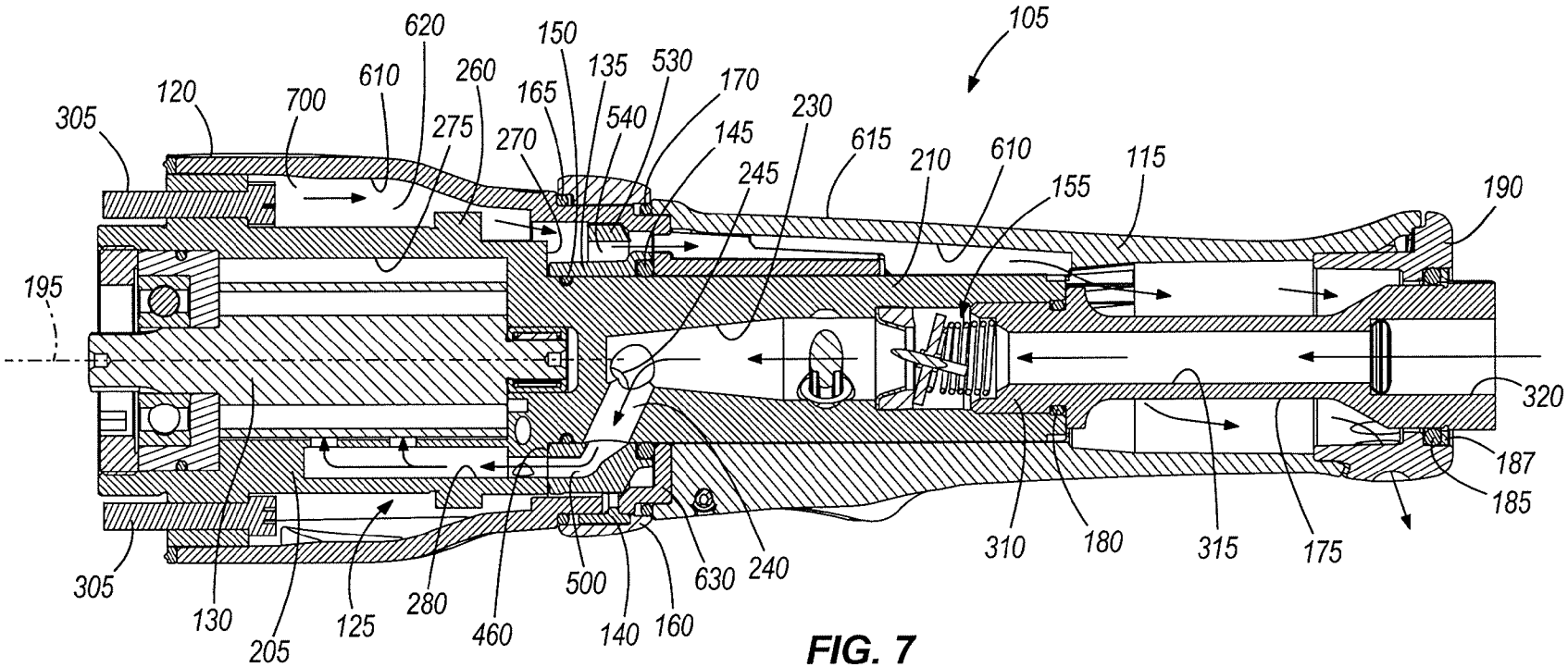
FIG. 7 is a cross-sectional view taken along line 7-7 in FIG. 6.

With reference to FIGS. 2 and 7, the inlet bushing 175 includes external threads 310 at one end that thread into the internal threads of the inlet passage 230 at the distal end 220 of the inlet conduit portion 210. The first inlet seal 180 provides a seal between the inlet conduit portion 210 and the inlet bushing 175. At the end opposite the external threads 310, the inlet bushing 175 is sealed within the exhaust cap 190 with the second inlet seal 185. The inlet bushing 175 defines a bushing passage 315 that communicates with the inlet passage 230. The inlet bushing 175 and bushing passage 315 define a bushing longitudinal axis that is collinear with the main 195. The inlet bushing 175 provides a fitting 320 that is adapted to mate with a fitting on a source of motive fluid (e.g., the outlet fitting on a supply hose providing compressed air, nitrogen, or another compressible fluid) supplied under pressure from a source, and conduct the motive fluid through the bushing passage 315 to the inlet passage 230. The inlet conduit portion 210, inlet passage 230, inlet bushing 175, and bushing passage 315 include longitudinal axes that are parallel to and substantially collinear with the main axis 195.

Figure 10:
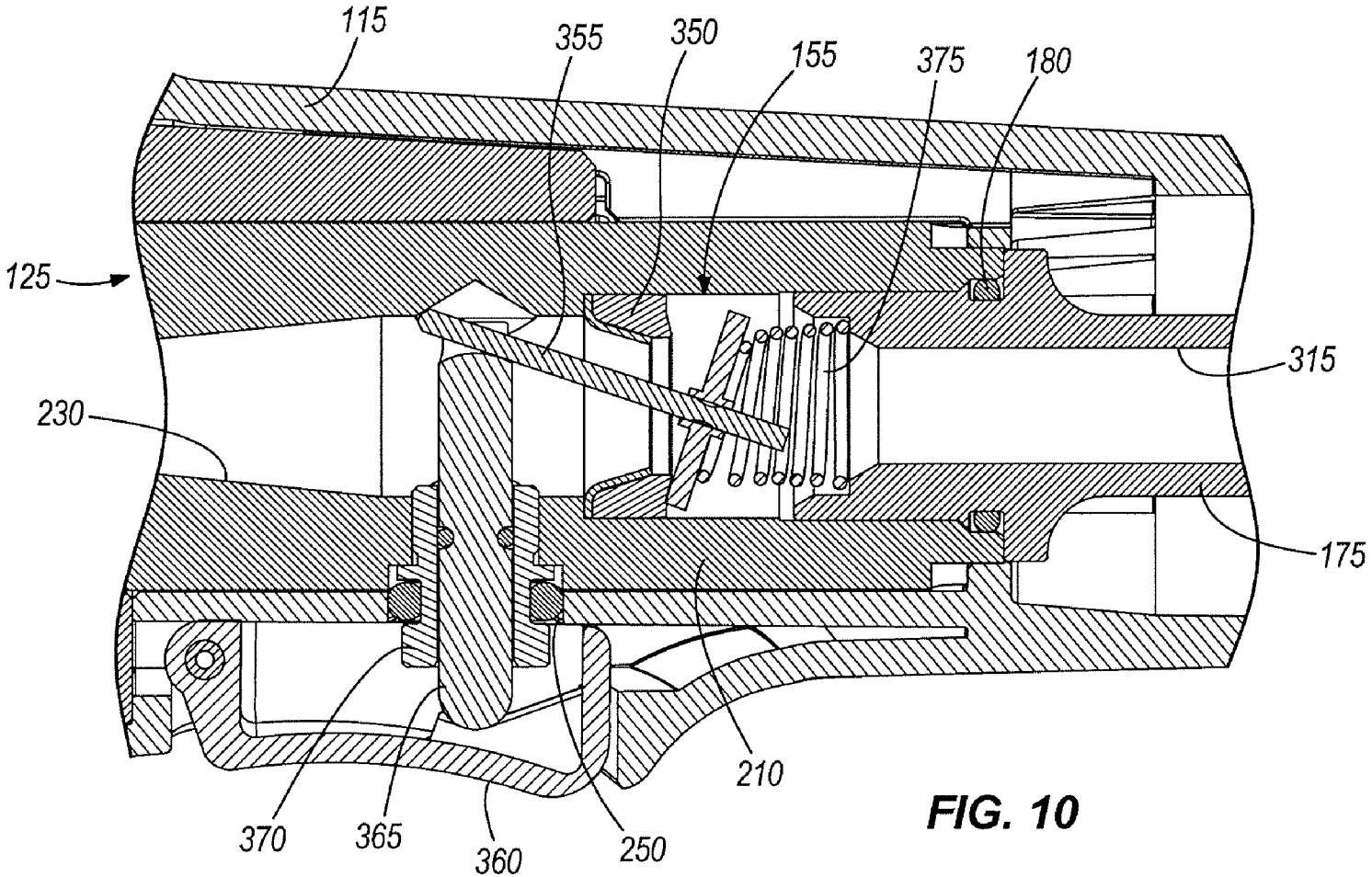
FIG. 10 is a cross-sectional view of the tool taken along line 10-10 in FIG. 1.

With reference to FIGS. 2 and 10, the throttle mechanism 155 includes a throttle seat 350 in a reduced-diameter portion of the inlet passage 230, and a "tip" style valve 355 that sits in the throttle seat 350. The throttle mechanism 155 also includes a trigger 360 mounted to the rear housing 115, and a throttle pin or actuator 365 extending between the trigger 360 and tip style valve 355 through a throttle bushing 370 in the throttle port 250. The throttle bushing 370 provides a seal around the throttle actuator 365 to resist the escape of motive fluid from the inlet passage 230 through the throttle port 250. The throttle actuator 365 moves linearly in the throttle bushing 370 in response to actuation of the trigger 360, and tips the tip style valve 355 with respect to the throttle seat 350, which opens communication between the bushing passage 315 and the inlet passage 230. When the tip style valve 355 is open, a pressurized supply of motive fluid rushes into the inlet passage 230 to drive operation of the tool 100. When the trigger 360 is released, the pressurized motive fluid, assisted by a spring 375, causes the tip style valve 355 to automatically re-seat itself and shut off the flow of motive fluid into the inlet passage 230.

Figure 5:
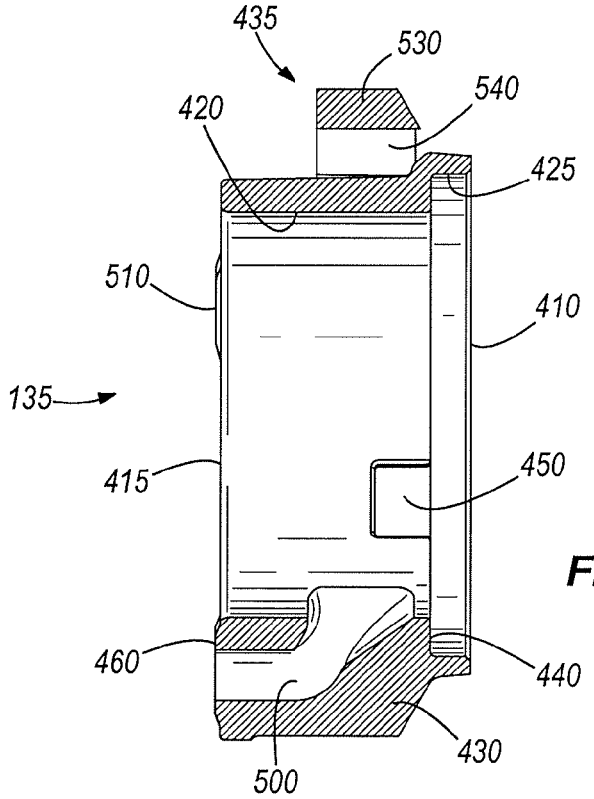
FIG. 5 is a cross-sectional view of the rotary valve taken along line 5-5 in FIG. 4A.
Figure 4A:
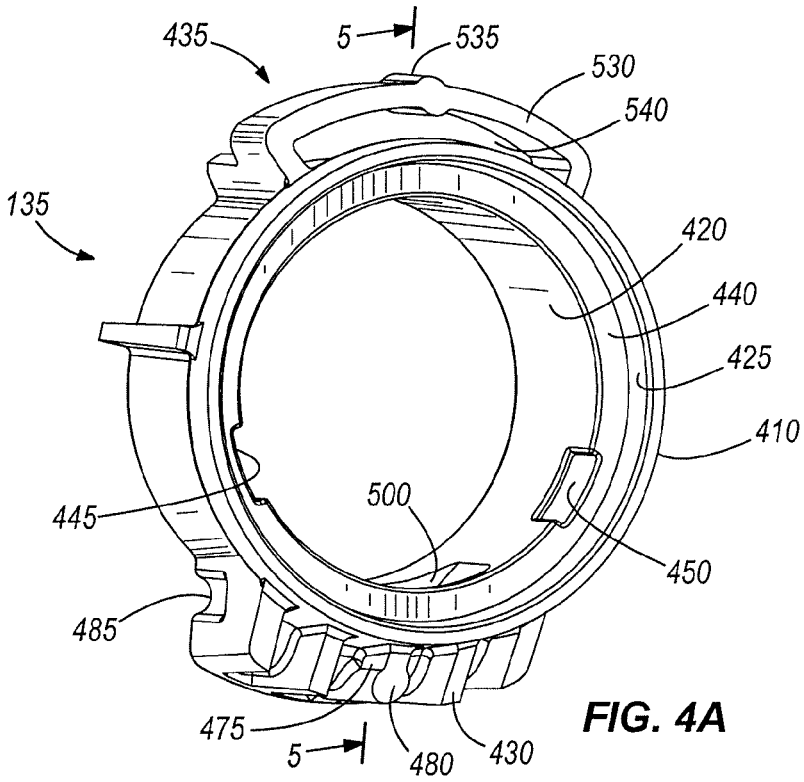
FIG. 4A is a rear perspective view of a rotary valve of the handle assembly.
Figure 4B:
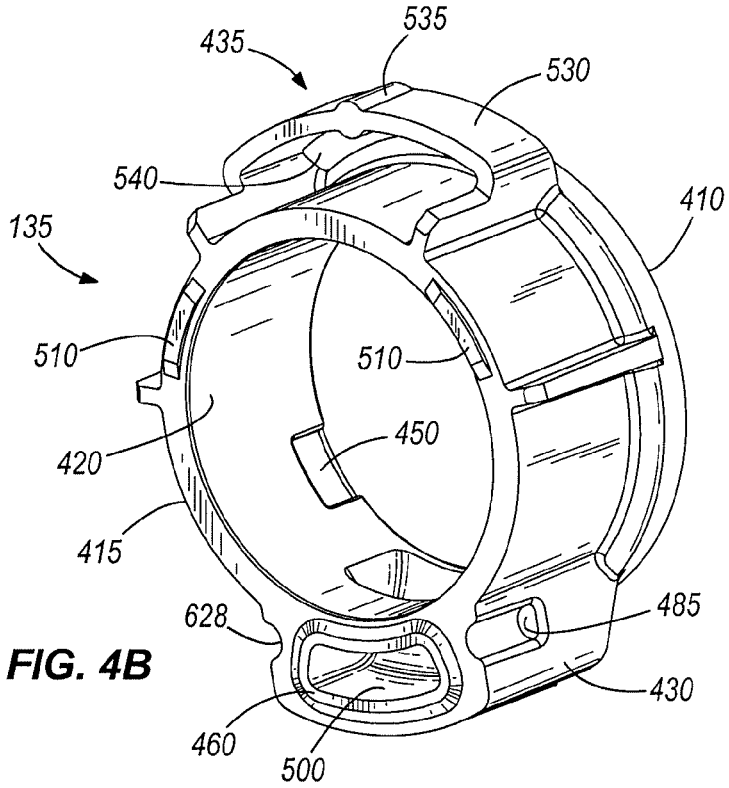
FIG. 4B is a front perspective view of the rotary valve.

FIGS. 4A, 4B, and 5 illustrate the rotary valve 135, which is generally ring-shaped, and which includes first and second ends 410, 415, a primary bore 420 extending between the first and second ends 410, 415, a counter bore 425 in the first end 410, an enlarged structural portion 430, and a resilient deflectable member 435. The entire rotary valve 135 is integrally formed as a single integral part in the illustrated embodiment.

A ring-shaped pressure biasing surface 440 is defined by the step between the primary bore 420 and the counter bore 425 at the first end 410. Forward and reverse undercuts or open channels 445, 450 in the primary bore 420, acting in conjunction with the exterior surface 225 of the inlet conduit portion 210 when assembled, define forward and reverse biasing passages that intersect the pressure biasing surface 440.

The enlarged structural portion 430 defines a second planar surface 460 at the second end 415 of the rotary valve 135, a mounting finger 475 with an enlarged head 480, and a forward power reduction ("FPR") port or groove 485. Extending through the enlarged structural portion 430 is a valve passage 500. The valve passage 500 communicates between the primary bore 420 and the second planar surface 460. A pair of stabilizing protrusions 510 are provided in the second end 415 of the rotary valve 135, and provide flat surfaces that are co-planar with each other and with the second planar surface 460.

The rest of the second end 415 is recessed with respect to the co-planar surfaces of the protrusions 510 and the second planar surface 460, and the three co-planar surfaces provide a three-legged riding surface for the second end 415 of the rotary valve 135 against the first planar surface 270. That is why there is a gap between the second end 415 and the first planar surface 270 in the cross-section views in the drawings (see, for example, FIGS. 8 and 9, and the top of the rotary valve 135 in FIG. 7) except where the protrusions 510 or second planar surface 460 contact the first planar surface 270.

The resilient deflectable member 435 includes a relatively thin-walled cross piece 530 with a detent protrusion 535 with a smooth partially-spherical surface. The cross piece 530 extends over an exhaust path aperture 540 in the rotary valve 135.

Figure 6:
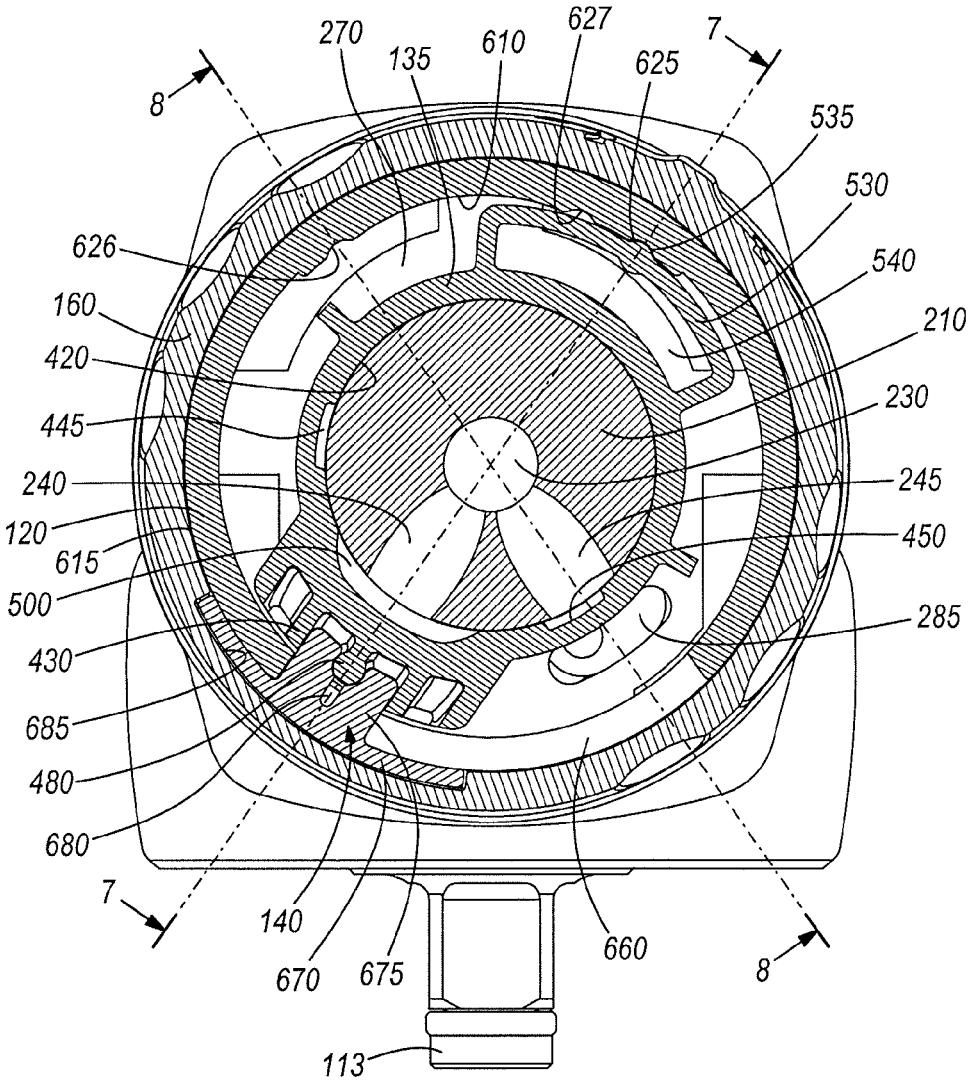
FIG. 6 is a cross-sectional view of the tool taken along line 6-6 in FIG. 1.

Referring now to FIG. 6, the primary bore 420 of the rotary valve 135 fits with close tolerances around the exterior surface 225 of the inlet conduit portion 210 of the motor cylinder 125, with the second planar surface 460 against the first planar surface 270. The primary bore 420 covers the forward and reverse ports 240, 245. The rotary valve 135 is supported for rotation about the exterior surface 225 of the inlet conduit portion 210 between a forward position, a reverse position, and a forward power regulation ("FPR") position in between the forward and reverse positions. The rotary valve 135 is illustrated in the forward position in FIG. 6.

Figure 9:
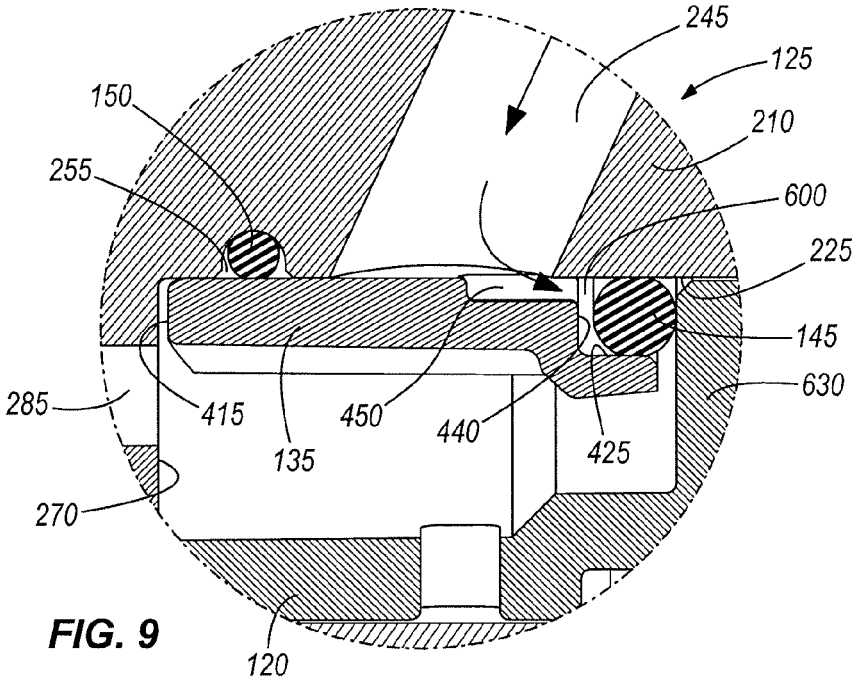
FIG. 9 is an enlarged view of the portion encircled in FIG. 8.

When the rotary valve 135 is in the forward position (as illustrated), the valve passage 500 communicates between the forward port 240 and the forward supply passage 280, and the reverse biasing passage 450 communicates with the reverse port 245. With additional reference to FIG. 7, when the rotary valve 135 in the forward position and the throttle mechanism 155 is actuated, motive fluid flows from the inlet passage 230, through the forward port 240, through the valve passage 500, through the forward supply passage 280, and to the motor chamber 275 where it expands and causes the rotor 130 to rotate in a forward direction. At the same time, motive fluid flows from the inlet passage 230, through the reverse port 245, through the reverse biasing passage 450, and into a biasing chamber 600 (FIG. 9, explained in detail below).

When the rotary valve 135 is in the reverse position, the valve passage 500 communicates between the reverse port 245 and the reverse supply passage 285, and the forward biasing passage 445 communicates with the forward port 240. With the rotary valve 135 in the reverse position, motive fluid flows from the inlet passage 230, through the reverse port 245, through the valve passage 500, through the reverse supply passage 285, and to the motor chamber 275 where it expands and causes the rotor 130 to rotate in a reverse direction (opposite the forward direction). At the same time, motive fluid flows from the inlet passage 230, through the forward port 240, through the forward biasing passage 445, and into the biasing chamber 600.

Figure 11:
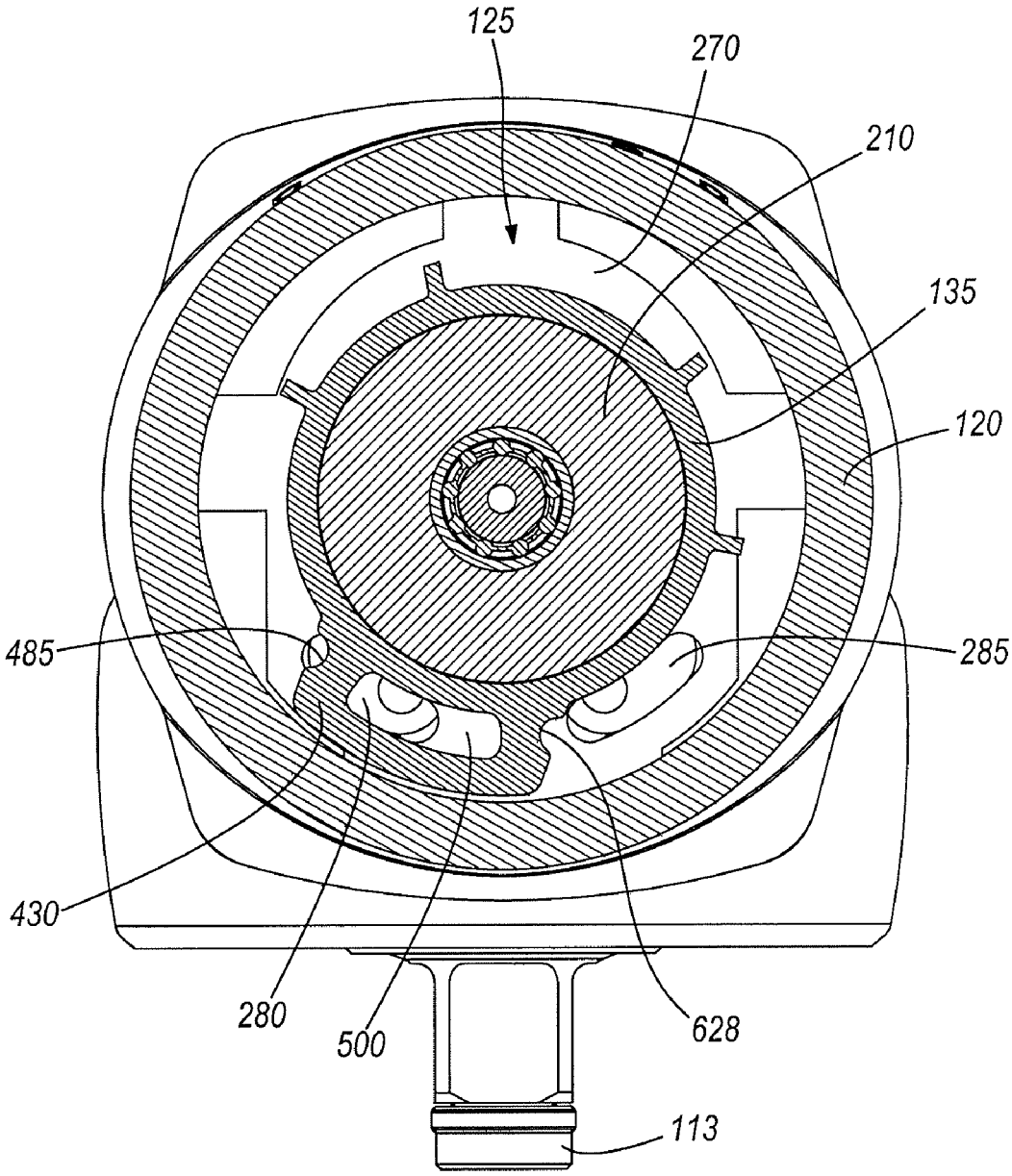
FIG. 11 is a cross-sectional view of the tool taken along line 11-11 in FIG. 1, with the rotary valve in a forward power reduction position.

With additional reference to FIG. 11, when the rotary valve 135 is in the FPR position, the valve passage 500 only partially aligns with the forward supply passage 280, and the FPR port 485 is also placed in communication with the forward supply port 280. Consequently, the flow of motive fluid into the motor chamber 275 is limited because some of the motive fluid flows out the FPR port into the exhaust passages (discussed in more detail below) without flowing into the motor chamber 275. In this regard, the FPR port may be termed a motor chamber bypass port as well, because it causes motive fluid to flow to exhaust without first flowing through the motor chamber 275. When the rotary valve 135 is in FPR position, the power of forward rotation of the rotor 130 is reduced, and torque applied by the tool 100 on a work piece is reduced. In the FPR position, the reverse biasing passages 450 still communicates between the reverse port 245 and the biasing chamber 600.

The outer housing 120, 115 includes an interior or inner surface 610 (i.e., facing the motor cylinder 125, valve 135, and bushing 175, see FIGS. 6 and 7) and an exterior or outer surface 615 (i.e., facing away from the motor cylinder 125, valve 135, and bushing 175, see FIGS. 2 and 7). As seen in FIG. 7, an exhaust passage 620 is defined between the inner surface 610 of the outer housing 115, 120 and the exterior surfaces 225, 265 of the motor cylinder 125 and bushing 175. A majority of the exhaust passage 620 extends substantially parallel to the main axis 195 to conduct exhausted motive fluid in a direction that is parallel to, but opposite the direction of motive fluid flowing into the tool 105, from the motor chamber 275 to the exhaust cap 190. A portion of the exhaust passage 620 extends through and is defined by the exhaust path aperture 540 in the rotary valve 135, and the exhaust passage 620 surrounds the rotary valve 135.

The inner surface 610 of the front housing 120 includes forward, reverse, and FPR detent grooves 625, 626, 627 into which the detent protrusion 535 of the deflectable member 435 of the rotary valve 135 is resiliently received when the rotary valve 135 is in the respective forward, reverse, and FPR positions. The detent protrusion 535 and detent grooves 625, 626, 627 together define a detent mechanism that resiliently holds the rotary valve 135 in the forward, reverse, and FPR positions (i.e., selected operating positions). In other embodiments, this arrangement may be reversed (e.g., with the deflectable member 435 on the front housing 120 and the detent grooves 625, 626, 627 on the rotary valve 135) or a different mechanism may be used.

While the illustrated embodiment provides only forward, reverse, and FPR detent grooves 625, 626, 627, other embodiments may include additional detent grooves to resiliently retain the rotary valve 135 in multiple FPR positions. Multiple FPR positions would permit the FPR port 485 to only partially register with the forward supply port 280, to restrict the amount of motive fluid that bypasses the motor chamber 275. One or more additional detent grooves may be provided to register a reverse power regulation ("RPR") port 628 (see FIGS. 4B and 11) with the reverse supply port 285 to bypass the motor chamber 275 and limit the reverse output in the same way as the FPR port 485 does in forward operation.

Figure 8:
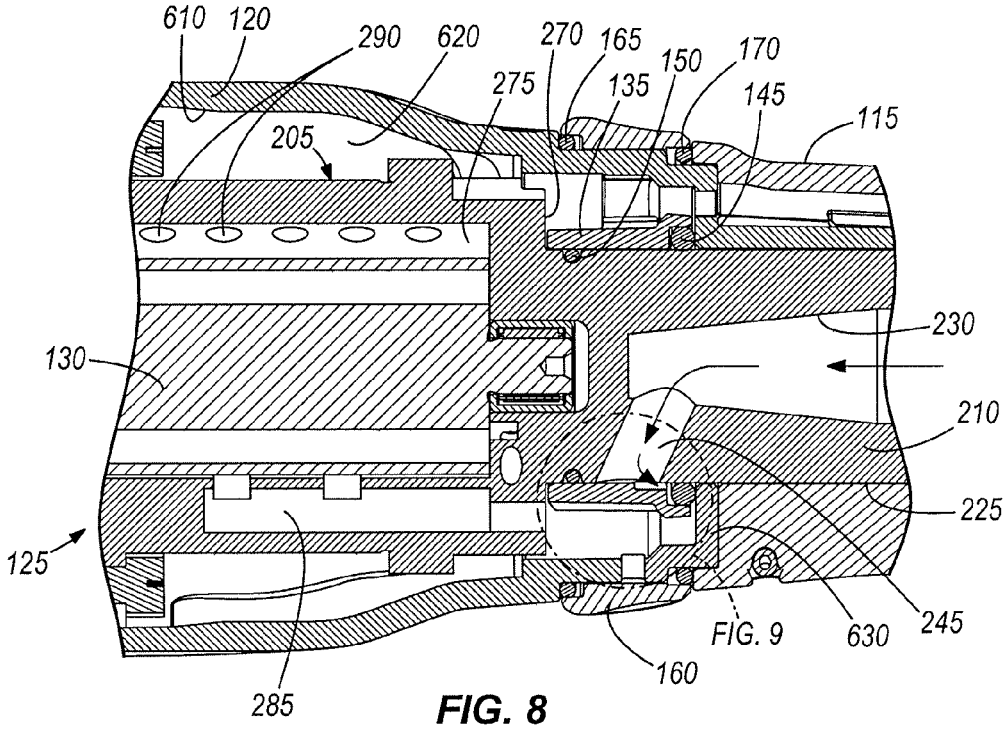
FIG. 8 is a cross-sectional view taken along line 8-8 in FIG. 6.

As seen in FIGS. 7-9, the first and second valve seals 145, 150 create a seal between the respective first and second ends of the rotary valve 135 and the exterior surface 225 of the inlet conduit portion 210. The first valve seal 145 extends around the exterior surface 225 of the inlet conduit portion 210 and sits between the exterior surface 225 and the counter bore 425. The second valve seal 150 is received within the seal seat 255 of the inlet conduit portion 210.

With additional reference to FIG. 9, the pressure biasing chamber 600 is defined between the first valve seal 145, the counter bore 425, the pressure biasing surface 440, and the exterior surface 225 of the inlet conduit portion 210. The first valve seal 145 includes a first face facing toward and at least partially defining the biasing chamber 600, and a second face facing away from and not defining any portion of the biasing chamber 600. A depending portion 630 of the front housing 120 abuts the second face of the first valve seal 145, but the pressure biasing chamber 600 is not bounded at all by any portion of the outer housing 115, 120.

In the biasing chamber 600, the pressure of the motive fluid (whether supplied through the forward or reverse biasing passage 445, 450) forces the second face of the first seal 145 against the depending portion 630 of the front housing 120, but the pressure does not apply a direct force against the front housing 120 (only indirectly through the first seal 145). The pressure is also applied to the pressure biasing surface 440 to give rise to a biasing force that urges the rotary valve 135 forward (i.e., to the left in FIGS. 7-9) to hold the second planar surface 460 (at the second end 415 of the rotary valve 135) tightly against the first planar surface 270.

A face seal arises between the first and second planar surfaces 270, 460 to resist the loss or leakage of motive fluid between the first and second planar surfaces 270, 460. Because the second planar surface 460 does not extend around the entire circumference of the second end 415 of the rotary valve 135, the biasing force is concentrated on the rotary valve second planar surface 460 and the two stabilizing protrusions 510. This provides a smaller surface area for transferring the biasing force to the first planar surface 270 than if the second planar surface extended around the entire circumference of the second end 415 of the rotary valve 135, and consequently a higher pressure applied by the second planar surface 460 against the first planar surface 270 and a better seal. The face seal is also advantageous because it does not include sealing members that will wear down during repeated actuation of the rotary valve 135; instead the smooth planar surfaces 270, 460 slide with respect to each other without significant wear. Thus, substantially all motive fluid flowing through the valve passage 500 and into the forward and reverse supply passages 280, 285 reaches the motor chamber 275 (unless the rotary valve 135 is in the FPR position in which some of the motive fluid is vented to exhaust intentionally). Leakage from the interface between the valve passage 500 and forward and reverse supply passages 280, 285 due to motive fluid flowing between the first and second planar surfaces 270, 460 is minimized or completely eliminated.

With reference to FIGS. 2 and 6, a ring seat 655 is formed in the outer surface 615 of the front housing 120. The ring 160 is supported in the ring seat 655 for rotation about the front housing 120. The ring 160 rotates about an axis of rotation that is collinear with the main axis 195.

A slot 660 (FIGS. 2 and 6) is formed in the ring seat 655. The valve actuator 140 includes an actuator head 670 and a stem 675. The stem 675 extends through the slot 660 in the ring seat 655 and includes a deflectable slot 680 that is sized to snap-fit around the enlarged head 480 of the mounting finger 475 of the rotary valve 135 to releasably interconnect the valve actuator 140 to and valve 135. In other embodiments, the finger and expandable slot 475, 680 may be reversed such that the stem 675 includes the enlarged head 480 and the rotary valve 135 includes the expandable slot 680. The present invention provides an interface that is simple to assemble or disassemble by hand, with no need for any tools. Currently-known and practiced constructions for reversing switches require a screwdriver, allen wrench, or like tool to assemble the valve actuator. While the illustrated snap-fit configuration is one embodiment of the present invention, other constructions and embodiments may include other means for interconnecting the rotary valve with a valve actuator by hand and without the use of tools.

The ring 160 includes a recess 685 ribs or other abutment surfaces that engage the opposite sides of the actuator head 670, and the ring 160 covers the valve actuator 140. The user interface to control forward, reverse, and FPR operation of the tool 100 is therefore the ring 160. Because the ring 160 covers the actuator head, it eliminates any visible or exposed connection interface (e.g., a screw) which can be unsightly or become loosened during tool use. Enclosing the actuator head 670 within the ring 670 also reduces the likelihood of accidental disengagement of the valve actuator 140 from the rotary valve 135.

An operator toggles the tool 100 between the forward, reverse, and FPR operations by rotating the ring 160 in one direction or the other, which overcomes the detent force of the detent mechanism (detent protrusion 535 and detent grooves 625, 626, 627) and causes the actuator head 670 to slide along the outer surface 615 of the front housing 120. This in turn causes movement of the rotary valve 135 through the stem 675. Rotating the ring 160 thereby switches direction of operation of the tool 100. The operator is rewarded with a tactile feedback as the detent mechanism (detent protrusion 535 and detent grooves 625, 626, 627) clicks into the forward, reverse, and FPR positions.

Figure 12:
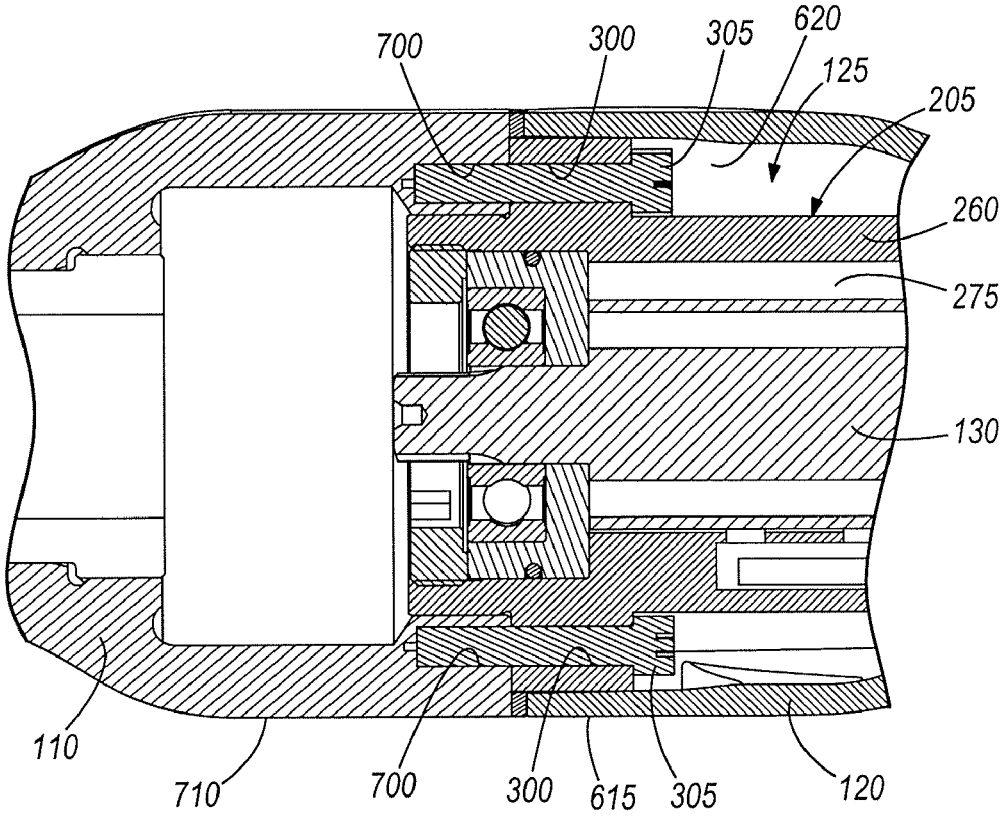
FIG. 12 is an enlarged view of the left end of the drawing of FIG. 7.

FIGS. 7 and 12 illustrate the mounting arrangement for the work attachment. The work attachment includes a plurality of attachment mounting holes 700 that align with the cylinder mounting holes 300. In the illustrated construction, the work attachment 110 is secured to the motor cylinder 125 with the fasteners 305. More specifically, the fasteners 305 extend through the cylinder mounting holes 300 and attachment mounting holes 700. In the illustrated embodiment, the attachment mounting holes 700 are internally threaded to receive an externally threaded end of the fasteners 305, and the cylinder mounting holes 300 are sized smaller than an enlarged head of the fasteners 305 so that the enlarged head bears against the flange portion of the motor cylinder 125. When mounted to the motor cylinder 125, the work attachment 110 is interconnected to the motor rotor 130 and is operable to perform work in response to rotation of the motor rotor 130.

The front housing 120 includes pockets in its interior surface 610 into which the housing support projections 213 of the motor cylinder 125 fit snugly. The interconnection of the pockets and housing support projections 213 properly locates (axially and radially) the front housing 120 with respect to the motor cylinder 125, and resists torsional loads between the front housing 120 and motor cylinder 125. A compliant gasket 710 sits between and provides a pressure tight seal between the work attachment 110 and the front housing 120 to resist leaking of exhaust motive fluid.

With the housing support projections 213 bottomed out in the pockets of the front housing 120, the front end of the outer housing extends around the flange portion of the motor cylinder 125 with a close clearance fit. The first ring seal 165, valve actuator 140, ring 160, and second ring seal 170 are then installed on the ring seat 655 portion of the front housing 120. Next the rear housing 115, exhaust cap 190, and inlet bushing 175 are assembled, with the first inlet seal 180 around the inlet bushing 175 above the threaded portion 310, and with the second inlet seal 185 and inlet washer 187 sandwiched between a portion of the inlet bushing 175 and a portion of the exhaust cap 190. The threaded end 310 of the inlet bushing 175 is threaded into the threaded portion of the inlet passage 230.

As the inlet bushing 175 is threaded into the inlet passage 230, it applies an axial thrust load on the rear housing 115 through the inlet washer 187, second inlet seal 185, and exhaust cap 190. As it is squeezed between the inlet bushing 175 and exhaust cap 190, the second inlet seal 185 provides a pressure-tight seal therebetween, and acts as a compliant member to accommodate tolerance stackups of the rigid components in the assembly. The rear housing 115 in turn applies a thrust load on the front housing 120 through a step in the rear housing 115 and the rear end of the front housing 120 (including the depending portion 630.

With work attachment 110 mounted to the motor cylinder 125 and the front housing mounted around the motor cylinder 125, the fasteners 305 are hidden from view outside of the tool 100 because they are within the work attachment 110 and the cavity bounded by the interior surface 610 of the outer housing 115, 120. Additionally, the outer surface of the work attachment 110 and the outer surface 615 of the outer housing 115, 120 are substantially aligned when the tool 100 is assembled, to create a substantially continuous tool outer surface that includes the outer surfaces of both the work attachment 110 and the outer housing 115, 120. Hiding the fasteners 305 in this manner provides a sleek appearance to the tool 100, resists tampering and disassembly of the tool, and physically shields the fasteners 305 from being caught on wires, edges, and other structures in a confined space, construction environment, or other work environment.

Figure 13:
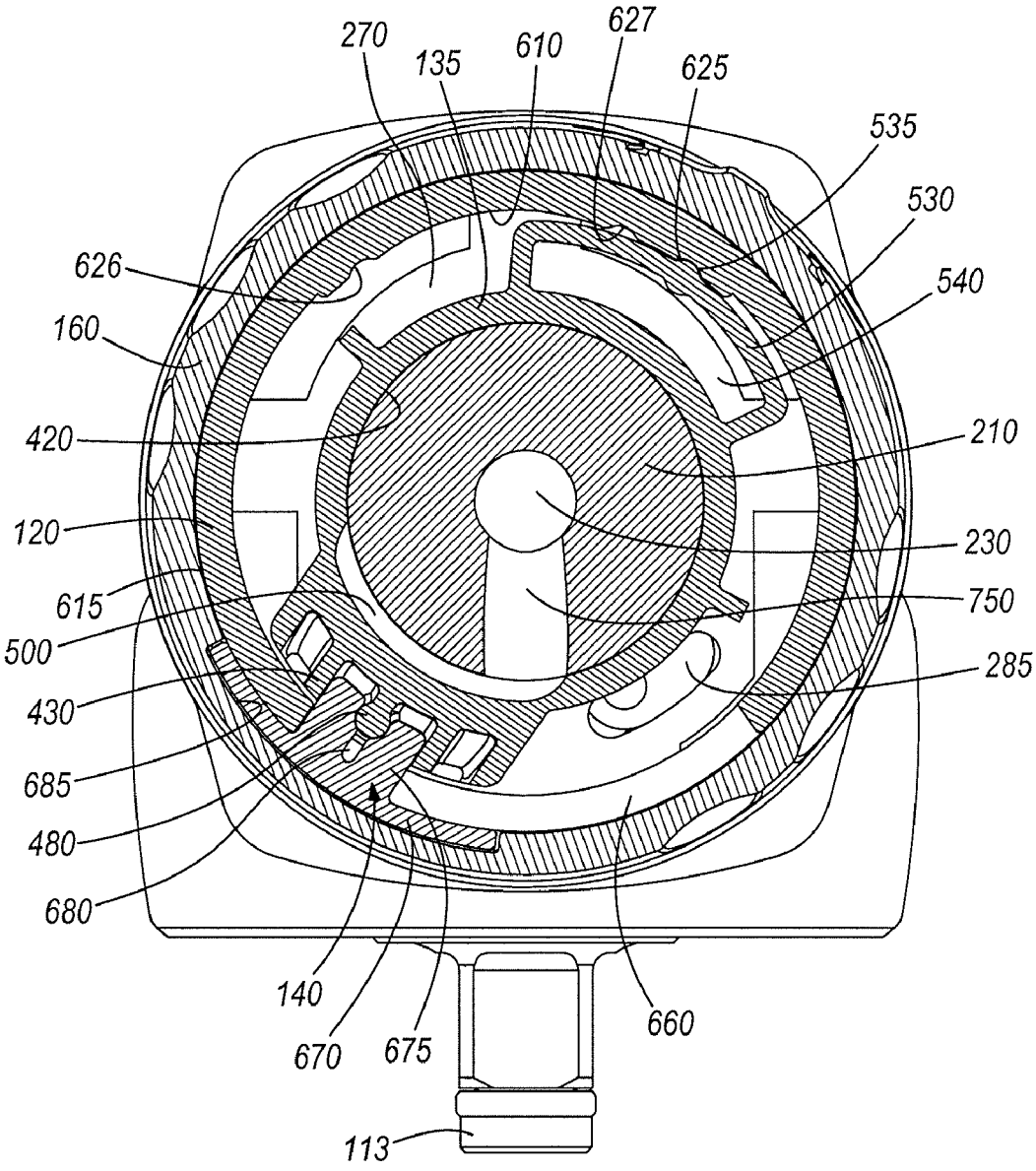
FIG. 13 is a cross-sectional view of the tool according to another embodiment of the invention.
Figure 14:
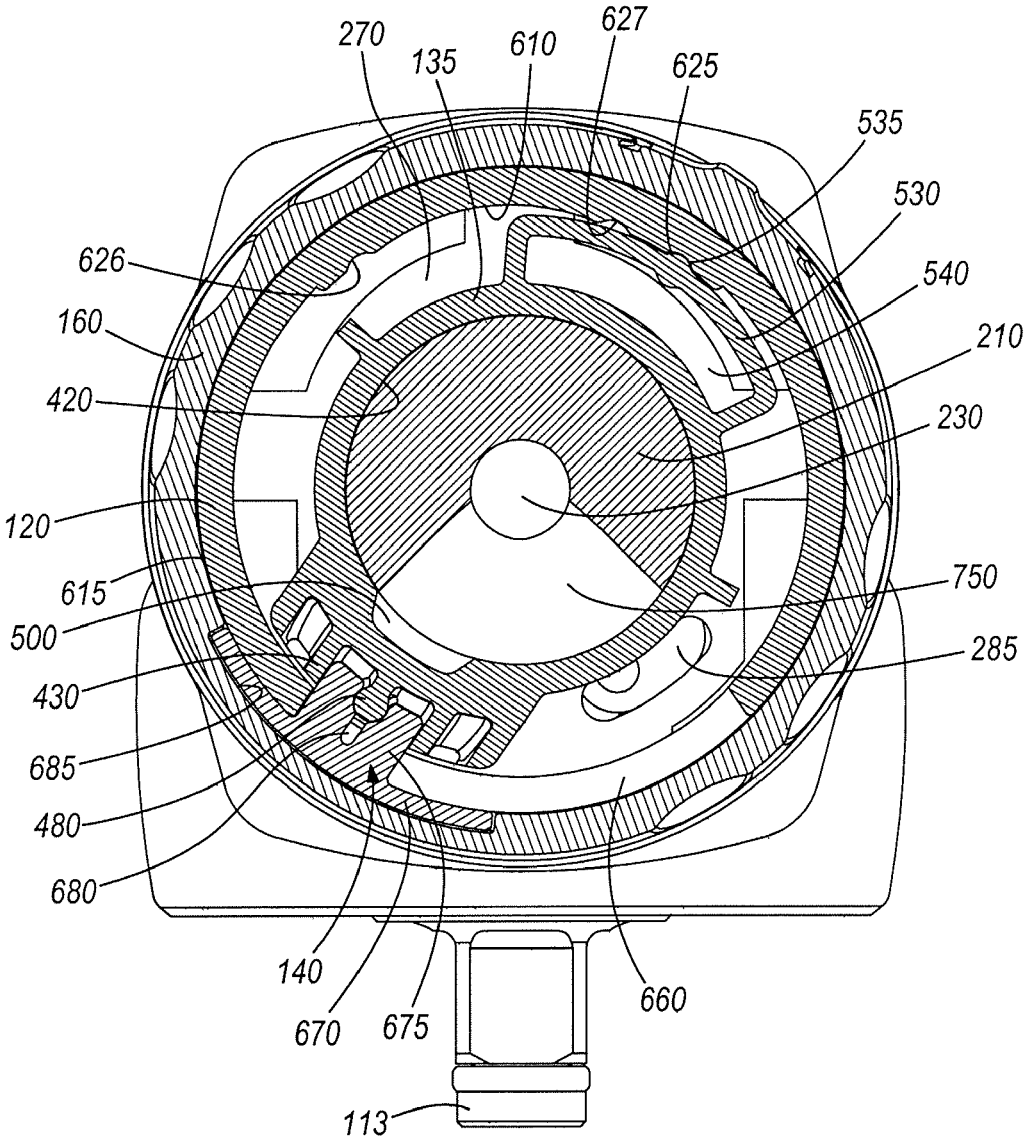
FIG. 14 is a cross-sectional view of the tool according to another embodiment of the invention.
Figure 15:
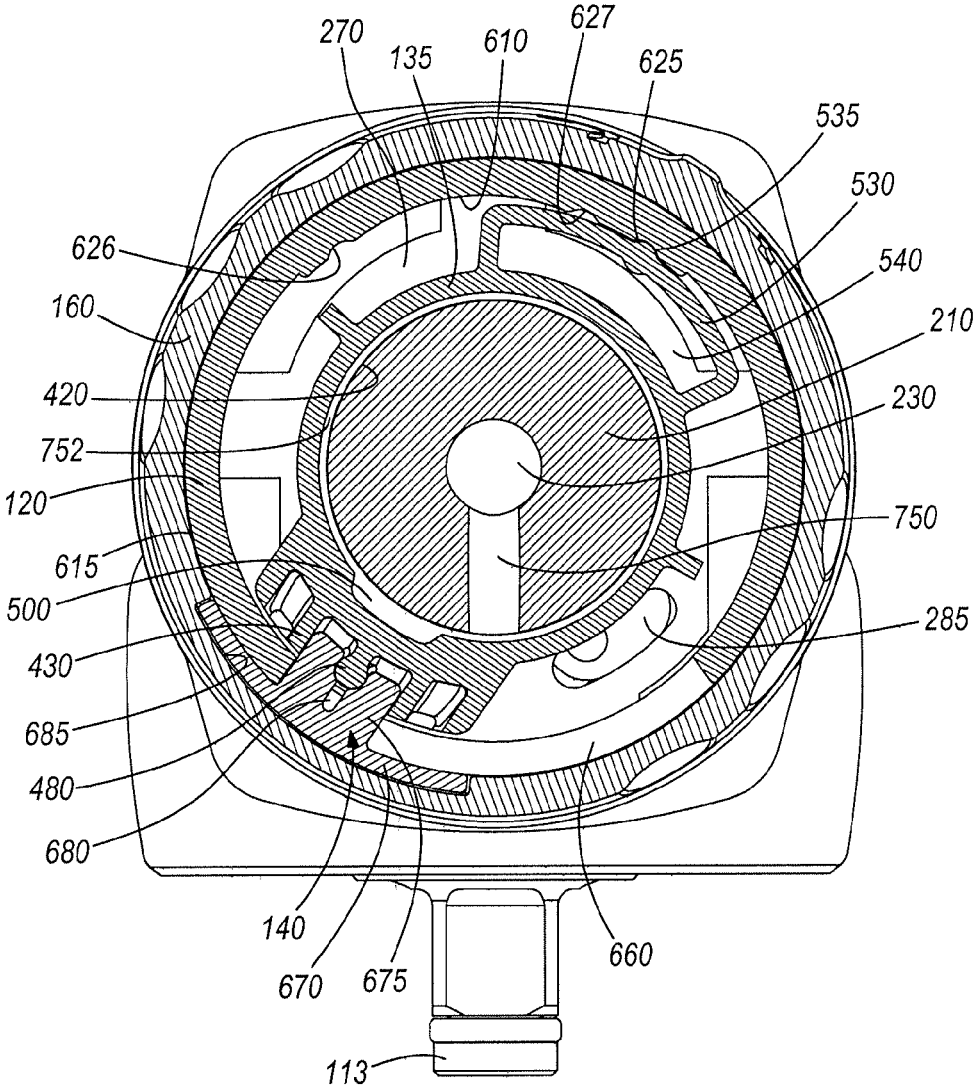
FIG. 15 is a cross-sectional view of the tool according to another embodiment of the invention.

FIGS. 13-15 include alternative embodiments of the interface between the inlet passage 230 and the rotary valve 135, in which a single supply port 750 communicates between the inlet passage 230 and the exterior surface 225 of the inlet conduit portion 210. In FIG. 13, the valve passage 500 is made large enough to stretch from the single supply port 750 to the forward supply passage 280 (i.e., with the right end of the valve passage 500 communicating with the single supply port 750 and the left end of the valve passage 500 communicating with the forward supply passage 280 as viewed in FIG. 13) when the rotary valve 135 is in the forward position, and to stretch from the single supply port 750 (i.e., at the left end of the valve passage 500 as viewed in FIG. 13) to the reverse supply passage 285 (i.e., at the right end of the valve passage 500) when the rotary valve 135 is in the reverse position.

In FIG. 14, the single supply port 750 widens at the exterior surface 225, so that the single supply port 750 stretches from the valve passage 500 in the forward position (i.e., with the valve passage 500 communicating between the forward supply passage 280 and the left end of the single supply port 750 as viewed in FIG. 14) to the valve passage 500 in the reverse position (i.e., with the valve passage 500 communicating between the reverse supply passage 285 and the right end of the single supply port 750).

In FIG. 15, the rotary valve 135 includes an annular groove in the primary bore 420 that communicates with the valve passage 500. The single supply port 750 communicates with the annular groove 752 in the primary bore 420. The valve passage 500 communicates between the annular groove 752 and the forward supply passage 280 in the forward position (as viewed in FIG. 15) and between the annular groove 752 and the reverse supply passage 285 in the reverse position.

Figure 16:
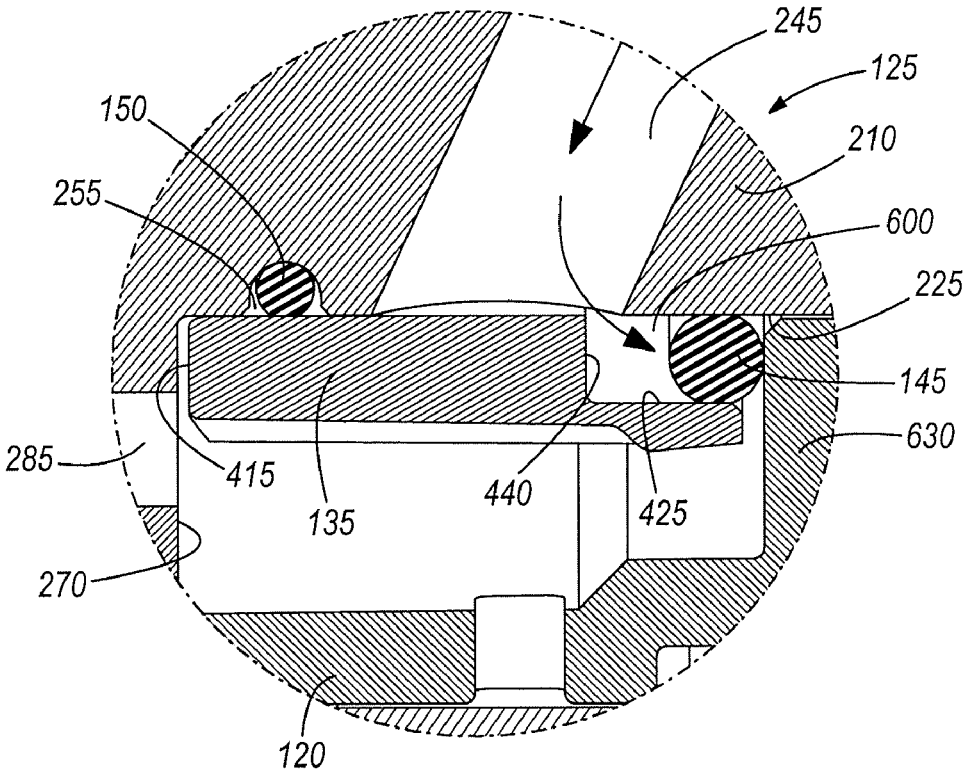
FIG. 16 is an enlarged view of a portion of the tool according to another embodiment of the invention.

FIG. 16 includes an alternate embodiment of the interface between the inlet valve 135 and the inlet conduit portion 210 forming the pressure biasing chamber 600. Rather than undercuts 445, 450 in the primary bore 420 to communicate with the pressure biasing chamber 600, the counterbore 425 extends inwardly to form a gap between the pressure biasing surface 440 and the end of the inlet conduit portion 210. This gap communicates the forward and reverse supply ports 240, 245 with the pressure biasing chamber 600.

Thus, the invention provides, among other things, a motor arrangement for a pneumatic tool. Various features and advantages of the invention are set forth in the following claims.

What is claimed is:

1. A pneumatic impact wrench comprising:

a handle assembly graspable by a user;

a work attachment coupled to the handle assembly;

an inlet permitting air flow into the pneumatic impact wrench to drive the impact wrench;

an outlet permitting air flow out of the pneumatic impact wrench;

a motor assembly positioned between the inlet and the outlet, the motor assembly including a rotor driven by the air flow between the inlet and the outlet, the motor assembly defining a longitudinal motor axis about which the rotor rotates;

an output drive coupled to the motor assembly and selectively rotated in response to rotation of the rotor, the output drive defining a longitudinal output axis about which the output drive rotates, wherein the longitudinal output axis is substantially perpendicular to the longitudinal motor axis;

an impact mechanism positioned between the motor assembly and the output drive, the impact mechanism selectively driving the output drive in response to rotation of the rotor;

a valve coupled to the handle assembly, the valve moveable between a first position, in which the pneumatic impact wrench operates in a forward direction, and a second position, in which the pneumatic impact wrench operates in a reverse direction; and a motor housing mounted around the rotor and valve, the motor housing including an inner surface facing toward the rotor and valve, and an outer surface facing away from the rotor and valve; an inlet passage defined between the inlet and the rotor, the inlet passage defining an inlet longitudinal axis; and an exhaust passage defined between the inner surface of the motor housing and the rotor; wherein a majority of the exhaust passage extends substantially parallel to the inlet longitudinal axis.

2. The pneumatic impact wrench of claim 1, further comprising a throttle mechanism coupled between the inlet and the motor assembly to permit actuation of the pneumatic impact wrench by a user.

3. The pneumatic impact wrench of claim 1, further comprising a valve actuator rotatable about the handle assembly to permit a user to move the valve between the first position and the second position.

4. The pneumatic impact wrench of claim 1, wherein a portion of the exhaust passage extends through a portion of the valve.

5. The pneumatic impact wrench of claim 1, further comprising a detent mechanism resiliently holding the valve in the first and second positions.

6. The pneumatic impact wrench of claim 1, wherein the impact mechanism comprises a hammer coupled to the rotor for rotation with the rotor, and an anvil coupled to the output drive, the hammer operable to impact the anvil to impactingly drive the output drive in response to rotation of the rotor.

7. A pneumatic impact wrench comprising:

a handle assembly graspable by a user;

a work attachment coupled to the handle assembly;

an inlet permitting air flow into the pneumatic impact wrench to drive the impact wrench;

an outlet permitting air flow out of the pneumatic impact wrench;

a motor assembly positioned between the inlet and the outlet, the motor assembly including a rotor driven by the air flow between the inlet and the outlet, the motor assembly defining a longitudinal motor axis about which the rotor rotates;

an output drive coupled to the motor assembly and selectively rotated in response to rotation of the rotor, the output drive defining a longitudinal output axis about which the output drive rotates, wherein the longitudinal output axis is substantially perpendicular to the longitudinal motor axis;

an impact mechanism positioned between the motor assembly and the output drive, the impact mechanism selectively driving the output drive in response to rotation of the rotor;

a valve coupled to the handle assembly, the valve moveable between a first position, in which the pneumatic impact wrench operates in a forward direction, and a second position, in which the pneumatic impact wrench operates in a reverse direction; and a motor housing mounted around the rotor and valve, the motor housing including a slot, an inner surface facing toward the rotor and valve, and an outer surface facing away from the rotor and valve; and a valve actuator including a head and a stem; wherein the head of the valve actuator is in sliding engagement with the outer surface of the motor housing; and wherein the stem extends through the slot in the motor housing to engage the valve, such that sliding the actuator head along the outer surface of the motor housing causes movement of the valve.

8. A pneumatic impact wrench comprising:

a handle assembly graspable by a user;

a work attachment coupled to the handle assembly;

an inlet permitting air flow into the pneumatic impact wrench to drive the impact wrench;

an outlet permitting air flow out of the pneumatic impact wrench;

a motor assembly positioned between the inlet and the outlet, the motor assembly including a rotor driven by the air flow between the inlet and the outlet, the motor assembly defining a longitudinal motor axis about which the rotor rotates;

a valve coupled to the handle assembly, the valve moveable between a first position, in which the rotor is rotated in a first direction, and a second position, in which the rotor is rotated in a second direction, opposite the first direction;

an output drive coupled to the motor assembly and selectively rotated in response to rotation of the rotor, the output drive defining a longitudinal output axis about which the output drive rotates, wherein the longitudinal output axis is substantially perpendicular to the longitudinal motor axis;

an impact mechanism positioned between the motor assembly and the output drive, the impact mechanism selectively driving the output drive in response to rotation of the rotor; and a motor housing mounted around the rotor and valve, the motor housing including an inner surface facing toward the rotor and valve, and an outer surface facing away from the rotor and valve; an inlet passage defined between the inlet and the rotor, the inlet passage defining an inlet longitudinal axis; and an exhaust passage defined between the inner surface of the motor housing and the rotor; wherein a majority of the exhaust passage extends substantially parallel to the inlet longitudinal axis.

9. The pneumatic impact wrench of claim 8, further comprising a throttle mechanism coupled between the inlet and the motor assembly to permit actuation of the pneumatic impact wrench by a user.

10. The pneumatic impact wrench of claim 8, wherein the impact mechanism comprises a hammer coupled to the rotor for rotation with the rotor, and an anvil coupled to the output drive, the hammer operable to impact the anvil to impactingly drive the output drive in response to rotation of the rotor.

11. The pneumatic impact wrench of claim 8, further comprising a valve actuator rotatable about the handle assembly to permit a user to move the valve between the first position and the second position.

12. The pneumatic impact wrench of claim 8, wherein a portion of the exhaust passage extends through a portion of the valve.

13. The pneumatic impact wrench of claim 8, further comprising a detent mechanism resiliently holding the valve in the first and second positions.

14. A pneumatic impact wrench comprising a handle assembly graspable by a user;

a work attachment coupled to the handle assembly;

an inlet permitting air flow into the pneumatic impact wrench to drive the impact wrench;

an outlet permitting air flow out of the pneumatic impact wrench;

a motor assembly positioned between the inlet and the outlet, the motor assembly including a rotor driven by the air flow between the inlet and the outlet, the motor assembly defining a longitudinal motor axis about which the rotor rotates;

a valve coupled to the handle assembly, the valve moveable between a first position, in which the rotor is rotated in a first direction, and a second position, in which the rotor is rotated in a second direction, opposite the first direction;

an output drive coupled to the motor assembly and selectively rotated in response to rotation of the rotor, the output drive defining a longitudinal output axis about which the output drive rotates, wherein the longitudinal output axis is substantially perpendicular to the longitudinal motor axis;

an impact mechanism positioned between the motor assembly and the output drive, the impact mechanism selectively driving the output drive in response to rotation of the rotor; and a motor housing mounted around the rotor and valve, the motor housing including a slot, an inner surface facing toward the rotor and valve, and an outer surface facing away from the rotor and valve; and a valve actuator including a head and a stem; wherein the head of the valve actuator is in sliding engagement with the outer surface of the motor housing; and wherein the stem extends through the slot in the motor housing to engage the valve, such that sliding the actuator head along the outer surface of the motor housing causes movement of the valve.

* * * * *